US011765512B2

(12) United States Patent
Ren et al.

(10) Patent No.: US 11,765,512 B2
(45) Date of Patent: Sep. 19, 2023

(54) ACOUSTIC DEVICE

(71) Applicant: AAC Microtech (Changzhou) Co., Ltd., Changzhou (CN)

(72) Inventors: Zhang Ren, Shenzhen (CN); Zhiwei Zhong, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/541,283

(22) Filed: Dec. 3, 2021

(65) Prior Publication Data

US 2023/0029866 A1 Feb. 2, 2023

(30) Foreign Application Priority Data

Aug. 2, 2021 (CN) ..... 202121788239.1

(51) Int. Cl.

| | |
|---|---|
| ***H04R 9/02*** | (2006.01) |
| ***H04R 7/16*** | (2006.01) |
| ***H04R 9/04*** | (2006.01) |
| ***H04R 9/06*** | (2006.01) |

(52) U.S. Cl.

CPC ..... *H04R 9/025* (2013.01); *H04R 7/16* (2013.01); *H04R 9/046* (2013.01); *H04R 9/06* (2013.01); *H04R 2400/11* (2013.01)

(58) Field of Classification Search

CPC . H04R 9/043; H04R 7/16; H04R 9/06; H04R 7/127; H04R 1/06; H04R 9/025; H04R 9/041; H04R 9/045; H04R 29/003; H04R 2207/00; H04R 2400/11; H04R 7/20; H04R 25/00; H04R 31/00; H04R 1/1016; H04R 2231/003; H04R 2499/11; H04R 2307/204; H04R 1/021; H04R 1/30; H04R 1/2811; H04R 1/2803; H04R 3/00; H04R 1/1025; H02J 50/005; H02J 50/10; H02J 7/0042

USPC ..... 381/396, 431, 420, 412, 400, 409, 424, 381/395, 388, 333, 386, 407, 410, 414, 381/419, 423, 152; 181/171, 172, 148, 181/153, 151

See application file for complete search history.

(56) References Cited

U.S. PATENT DOCUMENTS

| | | | | |
|---|---|---|---|---|
| 2011/0123061 | A1* | 5/2011 | Kamimura | H04R 31/00 381/412 |
| 2013/0016874 | A1* | 1/2013 | Huang | H04R 9/043 381/433 |
| 2018/0081406 | A1* | 3/2018 | Kita | H04R 9/06 |
| 2018/0302722 | A1* | 10/2018 | Linghu | H04R 9/025 |

(Continued)

*Primary Examiner* — Carolyn R Edwards
*Assistant Examiner* — Julie X Dang
(74) *Attorney, Agent, or Firm* — W&G Law Group

(57) ABSTRACT

The present invention provides an acoustic device including a frame, a magnetic circuit system and a vibration system. The magnetic circuit system includes a lower plate and a magnet assembly having a magnetic gap. The vibration system includes a diaphragm and a voice coil at least partially located in the magnetic gap. The frame includes a lower cover and a frame side wall. The vibration system is supported on the frame side wall. The lower plate includes a plate body spaced apart from the lower cover and a support wall bending and extending from the plate body toward the lower cover. The magnet assembly is supported and fixed on a surface of the plate body distal to the lower cover. The support wall abuts against and is fixed on the lower cover.

10 Claims, 6 Drawing Sheets

(56) References Cited

U.S. PATENT DOCUMENTS

2018/0302723 A1* 10/2018 Xiao ..... H04R 7/10
2021/0274289 A1* 9/2021 Wang ..... H04R 1/2834

* cited by examiner

ACOUSTIC DEVICE

FIELD OF THE PRESENT INVENTION

The present invention relates to electro-acoustic transducers, and more particularly, to an acoustic device used in electronic speaker box products.

DESCRIPTION OF RELATED ART

Whit the rapid development of wireless communication technologies, mobile phone and other consumer electronic products are widely used. The acoustic devices are also known as speakers or horns, and are often used in these products. Specifically, they are used in speaker boxes to convert audio signals into sound for playback.

In related art, the acoustic device usually includes an annular frame, a vibration system supported on the frame, and a magnetic circuit system driving the vibration system to generate to sound. The magnetic circuit system includes a yoke fixed on the frame and a magnet assembly received in the yoke. A magnetic gap is existed between the yoke and the magnet assembly.

However, in the acoustic device in related art, when the yoke is fixed on the frame, an area of a support connection face of the frame and a peripheral of the yoke is small. And there is no other support on the upper and lower sides of the yoke along the vibration direction. When the acoustic device falls off, the yoke is easily dropped from the frame, and the reliability of the acoustic device is poor.

Therefore, it is desired to provide a new acoustic device which can overcome the above problems.

SUMMARY

In view of the above, the embodiments of the present invention provide a new acoustic device. By the present invention, the acoustic device has a better reliability.

The present invention provides an acoustic device including a frame, a magnetic circuit system supported on the frame, and a vibration system supported on the frame. The magnetic circuit system comprises a lower plate fixed on the frame and a magnet assembly mounted on the lower plate and having a magnetic gap. The vibration system comprises a diaphragm and a voice coil at least partially located in the magnetic gap for driving the diaphragm to vibrate and generate sounds. The frame comprises a lower cover and a frame side wall bending and extending from a peripheral of the lower cover. The vibration system is supported on the frame side wall. The lower plate comprises a plate body opposite and spaced apart from the lower cover and a support wall bending and extending from the plate body toward the lower cover. The magnet assembly is supported and fixed on a surface of the plate body distal to the lower cover. The support wall abuts against and is fixed on the lower cover.

As an improvement, the support wall is formed by extending from a peripheral of the plate body along a vibration direction of vibration system, and the support wall is arranged spaced apart from the frame side wall.

As an improvement, there is a plurality of said support walls, and each support wall is spaced apart from each other.

As an improvement, the frame is made of metal material, and each support wall is soldered and fixed to the lower cover.

As an improvement, the number of the support walls is four, the plate body is in a rectangular shape, the four support walls bend and extend from four sides of the plate body respectively.

As an improvement, the magnet assembly comprises a main magnet secured on the plate body and a plurality of auxiliary magnets around and spaced apart from the main magnet for forming the magnetic gap.

As an improvement, the diaphragm comprises an annular dome, an annular first suspension, an annular second suspension surrounded by and spaced apart from the first suspension, a first fixation portion bending and extending from a side of the first suspension proximal to the second suspension, the dome located between and connected with the first suspension and the second suspension;

the dome comprises an annular dome body and a first dome extending wall bending and extending from the dome body along a direction toward the magnetic circuit system, the first fixation portion connects to and wraps the first dome extending wall.

As an improvement, the vibration system further comprises a support connecting the diaphragm and the voice coil, the support comprises a support flat wall, a first support extending wall, and a second support extending wall, the support flat wall is attached to a surface of the dome body proximal to the voice coil, the first support extending wall bends and extends from a side of the support flat wall proximal to the first suspension along the direction toward the magnetic circuit system, the first support extending wall is arranged spaced apart from and opposite to the first dome extending wall, the second support extending wall extends from a side of the support flat wall proximal to the second suspension along the direction toward the voice coil and is fixed to the voice coil.

As an improvement, the first fixation portion comprises a first holding wall bending and extending from a side of the first suspension proximal to the second suspension, a first side wall bending and extending from a side of the first holding wall proximal to the first suspension along a vibration direction toward the magnetic circuit system, a first top wall bending and extending from the first side wall along the direction away from the first suspension, and a second side wall bending and extending from the first top wall along the vibration direction away from the magnetic circuit system, the first side wall, the first top wall, and the second side wall cooperatively enclose a first receiving slot for accommodating the first dome extending wall, an outer peripheral of the dome body is attached to a surface of the first holding wall proximal to the magnetic circuit system.

As an improvement, the diaphragm further comprises a second fixation portion bending and extending from a side of the second suspension closed to the first suspension, the dome comprises a second dome extending wall bending and extending from a side of the dome body distal to the first dome extending wall to the direction toward the magnetic circuit system, the second fixation portion connects to and wraps the second dome extending wall;

the second fixation portion comprises a second holding wall and a third side wall bending and extending from a side of the second suspension closed to the first suspension, the second holding portion is arranged spaced apart from the third side wall and cooperatively encloses a second receiving slot with the third side wall, the second dome extending wall is received in the second receiving slot, an inner peripheral of the dome body is attached to the surface of the second holding wall proximal to the voice coil.

As an improvement, both of the first suspension and the second suspension are in arc-shaped structures, each of the first suspension and the second suspension has a recess direction, and the two recess directions are in opposite directions.

BRIEF DESCRIPTION OF THE DRAWINGS

Many aspects of the exemplary embodiments can be better understood with reference to the following drawing. The components in the drawing are not necessarily drawn to scale, the emphasis instead being placed upon clearly illustrating the principles of the present invention. Moreover, in the drawings, like reference numerals designate corresponding parts throughout the several views.

DETAILED DESCRIPTION OF THE EXEMPLARY EMBODIMENTS

Figure 1:
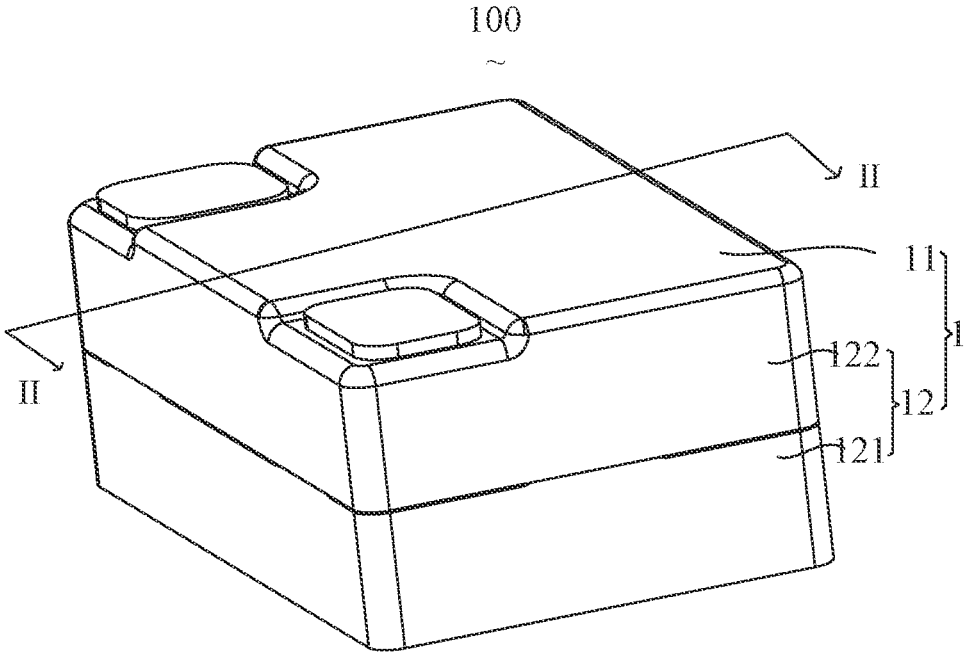
FIG. 1 is an illustrative isometric view of an acoustic device in accordance with one embodiment of the present invention.
Figure 2:
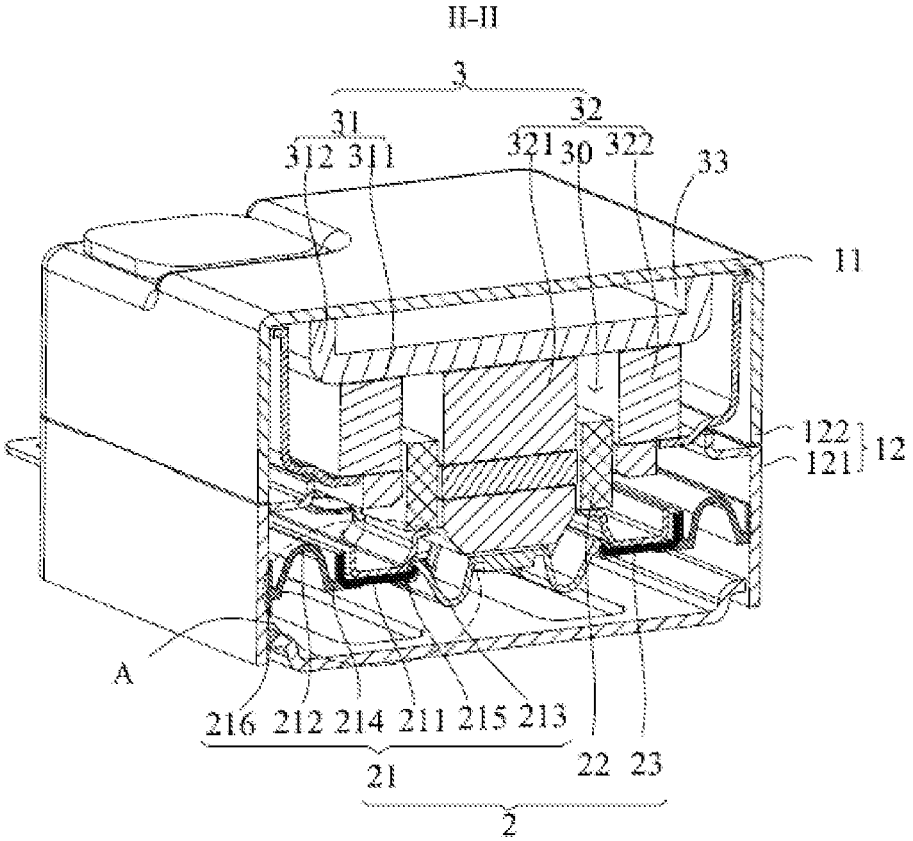
FIG. 2 is an illustrative cross-sectional view of the acoustic device taken along line II-II of FIG. 1.

The present invention will hereinafter be described in detail with reference to exemplary embodiments. To make the technical problems to be solved, technical solutions and beneficial effects of the present invention more apparent, the present invention is described in further detail together with the figures and the embodiments. It should be understood the specific embodiments described hereby is only to explain the disclosure, not intended to limit the disclosure.

Referring to the FIGS. 1-6, the present invention provides one embodiment of an acoustic device 100. The acoustic device 100 includes a frame 1, a vibration system 2 supported on the frame 1, a magnetic circuit system 3 driving the vibration system 2 to generate to sound. The magnetic circuit system 3 includes a lower plate 31 fixed on the frame 1 and a magnet assembly 32 mounted on the lower plate 31. The magnet assembly 32 has a magnetic gap 30. The magnet assembly 32 includes a main magnet 321 and a plurality of auxiliary magnets 322 around and spaced apart from the main magnet 321 for forming the magnetic gap 30. The vibration system 2 includes a diaphragm 21 and a voice coil 22 at least partially located in the magnetic gap 30 for driving the diaphragm 21 to vibrate and generate sounds.

The frame 1 includes a lower cover 11 and a frame side wall 12 bending and extending from a peripheral of the lower cover 11. The vibration system 2 is supported on the frame side wall 12. The lower plate 31 includes a plate body 311 opposite and spaced apart from the lower cover 11 and a support wall 312 bending and extending from the plate body 311 toward the lower cover 11. The magnet assembly 32 is supported and fixed on a surface of the plate body 311 distal to the lower cover 11. The support wall 312 abuts against and is fixed on the lower cover 11.

Therefore, in present invention, the support wall 312 is formed by turning the lower plate 31 toward the lower cover 11, and by fixing the support wall 312 and the lower cover 11 together, a connection area of a peripheral of the lower plate 31 and the lower cover 11 can be enlarged. The firmness of the connection between the lower plate 31 and the lower cover 11 is increased, and the overall structural strength is improved. It guarantees the reliability of frame 1 and the magnetic circuit system 3 when the acoustic device 100 is falling off, and it improves the sound performance of the acoustic device 100.

In order to facilitate the assembly of the vibration system 2 and the magnetic circuit system 3, the frame side wall 12 includes an upper side wall 121 and a lower side wall 122 supported on the upper side wall 121 and integrally connected to the lower cover 11. The upper side wall 121 and the lower side wall 122 are two independent structures. The vibration system 2 is secured on an inner peripheral of the upper side wall 121. The lower side wall 122 and the lower cover 11 cooperative to form an accommodating room for receiving the magnetic circuit system 3. When assembling the acoustic device 100, the vibration system 2 and the magnetic circuit system 3 can be assembled separately. The vibration system 2 can be fixed in the upper side wall 121 firstly, meanwhile, the magnetic circuit system 3 can be fixed in the accommodating room, and then the upper side wall 121 and the lower side wall 122 can be aligned and assembled. Thus, the assembly of the vibration system 2 and the magnetic circuit system 3 is finished.

In present embodiment, the support wall 312 is formed by extending from a peripheral of the plate body 311 along a vibration direction of vibration system 2. It provides support for the lower plate 31 in the direction of vibration. When the acoustic device drops, it reduces the risk of falling of the lower plate 31 and the lower cover 11. The support wall 312 is arranged spaced apart from the frame side wall 12. The support wall 312, the plate body 311 and the lower cover 11 cooperatively form a room 33

Figure 3:
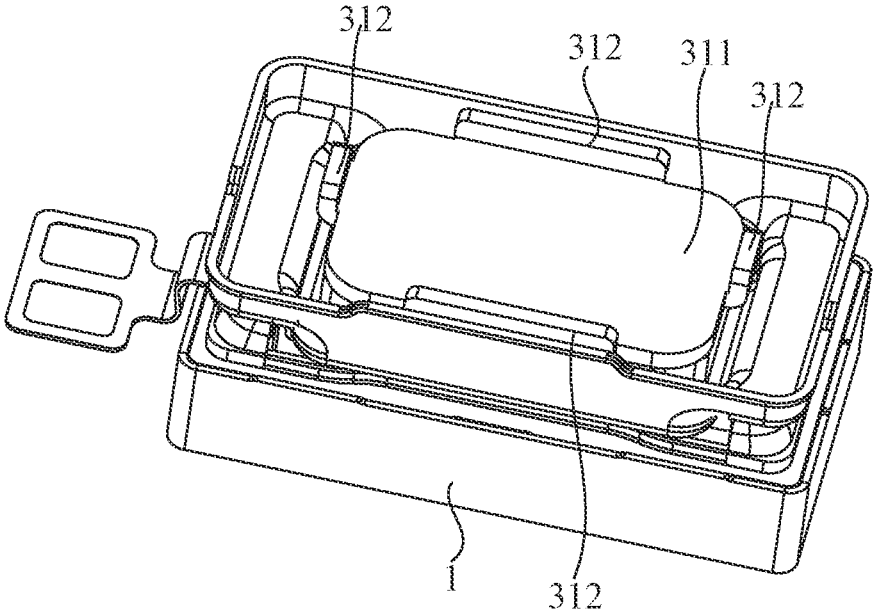
FIG. 3 is partially perspective view of the acoustic device removing the lower cover.
Figure 4:
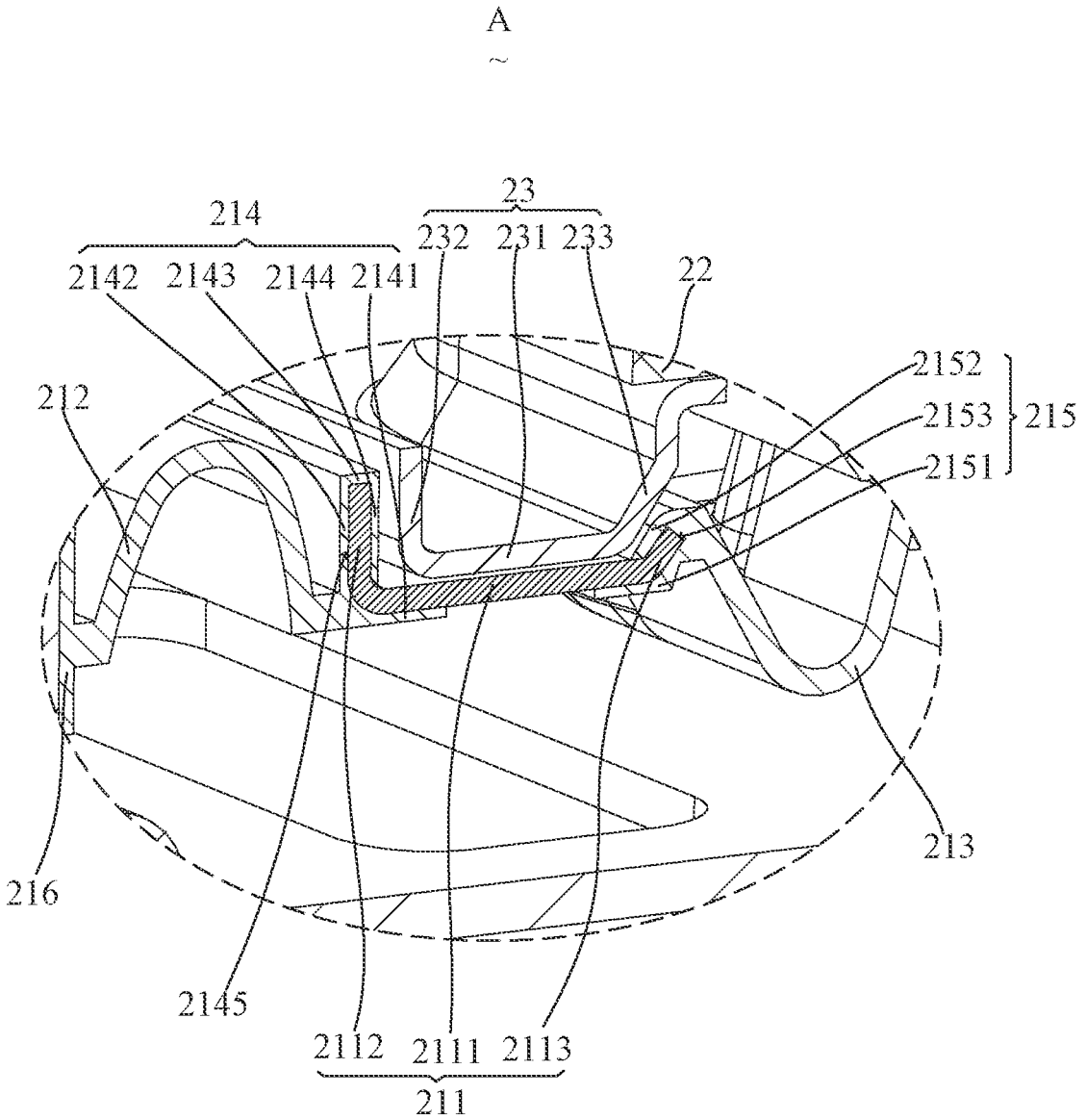
FIG. 4 is an enlarged view of the acoustic device of circled part A of FIG. 2.
Figure 5:
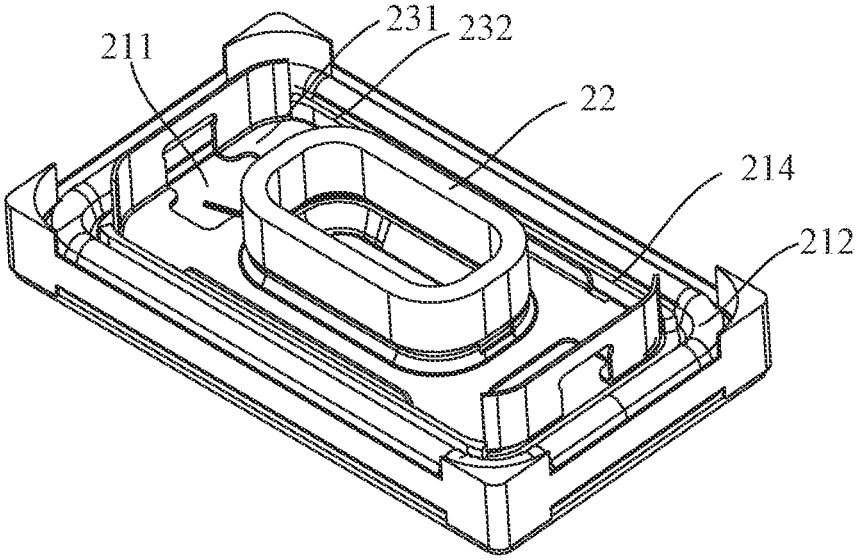
FIG. 5 is a partially isometric view of partly members of the acoustic device of the present invention.
Figure 6:
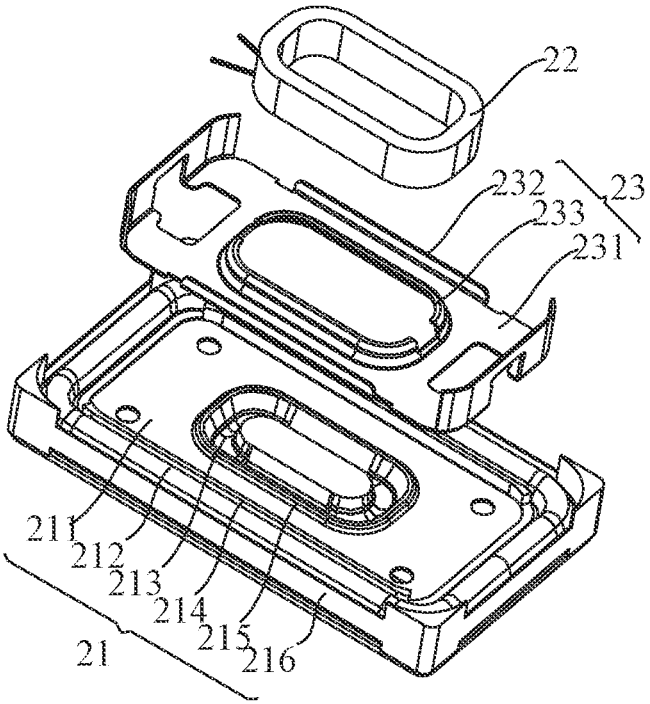
FIG. 6 is an exploded view of partly members of the acoustic device of FIG. 5.

There is a plurality of said support walls 312, and each support wall 312 is spaced apart from each other. The frame 1 is made of metal material, and each support wall 312 is soldered and fixed to the lower cover 11. This can effectively save space. Referring also to FIG. 3, the number of the support walls 312 is four. The plate body 311 is in a rectangular shape. The four support walls 312 bend and extend from four sides of the plate body 311 respectively. And in other embodiments, the support walls 312 can be a whole annular structure extending from the plate body, or the number of the support walls can be other numbers.

The vibration system 2 further comprises a support 23 connecting the diaphragm 21 and the voice coil 22.

The diaphragm 21 comprises an annular dome 211, an annular first suspension 212, an annular second suspension 213 surrounded by and spaced apart from the first suspension 212. The dome 211 locates between and connected with the first suspension 212 and the second suspension 213. The diaphragm 21 further comprises a first fixation portion 214 bending and extending from a side of the first suspension 212 proximal to the second suspension 213, a second fixation portion 215 bending and extending from a side of the second suspension 213 closed to the first suspension 212, and a third fixation portion 216 bending and extending from a side of the first suspension 212 distal to the second suspension 213. The third fixation portion 216 is mounted to an inner peripheral of the frame 1. The dome 211 comprises an annular dome body 2111 and a first dome extending wall 2112 bending and extending from the dome body 2111 along a direction toward the magnetic circuit system 3. The first fixation portion 214 connects to and wraps the first dome extending wall 2112.

Both of the first suspension 212 and the second suspension 213 are in arc-shaped structures, each of the first suspension 212 and the second suspension 213 has a recess direction, and the two recess directions are in opposite directions. In detail, the recess direction of the first suspension 212 is a direction proximal to the voice coil 22, and the recess direction of the second suspension 213 is a direction distal to the voice coil 22.

The support 23 comprises a support flat wall 231, a first support extending wall 232, and a second support extending wall 233. The support flat wall 231 is attached to a surface of the dome body 2111 proximal to the voice coil 22. The first support extending wall 232 bends and extends from a side of the support flat wall 231 proximal to the first suspension 212 along the direction toward the magnetic circuit system 3. The first support extending wall 232 is arranged spaced apart from and opposite to the first dome extending wall 2112. The second support extending wall 233 extends from a side of the support flat wall 231 proximal to the second suspension 213 along the direction toward the voice coil 22 and is fixed to the voice coil 22.

Furthermore, the first dome extending wall 2112 is formed by extending from an outer peripheral of the dome body 2111 along the vibration direction of the diaphragm 21, and the first support extending wall 232 is formed by extending from the side of the support flat wall 231 proximal to the first suspension 212 along the vibration direction.

And furthermore, in order to enhance the strength of the connection between the dome 211 and the first fixation portion 214, the first fixation portion 214 comprises a first holding wall 2141 bending and extending from a side of the first suspension 212 proximal to the second suspension 213, a first side wall 2142 bending and extending from a side of the first holding wall 2141 proximal to the first suspension 212 along the vibration direction toward the magnetic circuit system 3, a first top wall 2143 bending and extending from the first side wall 2142 along the direction away from the first suspension 212, and a second side wall 2144 bending and extending from the first top wall 2143 along the vibration direction away from the magnetic circuit system 3. The first side wall 2142, the first top wall 2143, and the second side wall 2144 cooperatively enclose a first receiving slot 2145 for accommodating the first dome extending wall 2112. An outer peripheral of the dome body 2111 is attached to a surface of the first holding wall 2141 proximal to the magnetic circuit system 3.

The first support extending wall 232 is arranged spaced apart from the second side wall 2144. In other words, the first support extending wall 232 is arranged spaced apart from the first dome extending wall 2112. A gap is existed between the first support extending wall 232 and the first dome extending wall 2112.

In present embodiment, the dome 211 comprises a second dome extending wall 2113 bending and extending from a side of the dome body 2111 distal to the first dome extending wall 2112 to the direction toward the magnetic circuit system 3. The second fixation portion 215 connects to and wraps the second dome extending wall 2113. There may be a certain angle between the bending direction of the second dome extending wall 2113 and the vibrating direction of the diaphragm 21. That is, the second dome extending wall 2113 can extend not along the vibration direction. The second fixation portion 215 comprises a second holding wall 2151 and a third side wall 2152 bending and extending from a side of the second suspension 213 closed to the first suspension 212. The second holding portion 2151 is arranged spaced apart from the third side wall 2152 and cooperatively encloses a second receiving slot 2153 with the third side wall 2152. The second dome extending wall 2113 is received in the second receiving slot 2153. An inner peripheral of the dome body 2111 is attached to the surface of the second holding wall 2151 proximal to the voice coil 22. Therefore, the outer peripheral of the dome body 2111 is located on the first holding wall 2141, and the inner peripheral of the dome body 2111 is located on the second holding wall 2151, which not only can improve the reliability of the connection of the dome body 2111, the first fixation portion 214 and the second fixing portion 215, but also can enhance the strength of the connection position.

Therefore, in present embodiment, by making the dome and the support having the extending walls bending toward the magnetic circuit system, it is beneficial to enhance the strength of the vibration system, and to a certain extent, it can improve the impact of split vibration on performance, and it expands and improves the high frequency of the acoustic device.

Comparing with the related art, in the acoustic device of present invention, the acoustic device includes a frame, a vibration system supported on the frame, a magnetic circuit system supported on the frame and driving the vibration system to sound. The magnetic circuit system comprises a lower plate fixed on the frame and a magnet assembly mounted on the lower plate and having a magnetic gap. The frame comprises a lower cover and a frame side wall bending and extending from a peripheral of the lower cover, and the vibration system is supported on the frame side wall. The lower plate comprises a plate body opposite and spaced apart from the lower cover and a support wall bending and extending from the plate body toward the lower cover. The magnet assembly is supported and fixed on a surface of the plate body distal to the lower cover. The support wall abuts against and is fixed on the lower cover. From this, the connecting area of the peripheral of the lower plate and the lower cover can be enlarged, the strength of whole acoustic device is enhanced. It guarantees the reliability of frame and the magnetic circuit system when the acoustic device is falling off, and it improves the sound performance of the acoustic device.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. An acoustic device, comprising:

a frame comprising:

a flat lower cover;

a frame side wall bending and extending from a peripheral of the lower cover;

a magnetic circuit system supported on the frame, the magnetic circuit system comprising:

a lower plate fixed on the frame comprising:

a plate body opposite and spaced apart from the lower cover;

at least one support wall bending and extending from the plate body toward the lower cover, the at least one support wall abutting against and fixed on the lower cover, and the at least one support wall, the plate body and the lower cover cooperatively forming a room;

a magnet assembly having a magnetic gap supported and fixed on a surface of the plate body distal to the lower cover;

a vibration system supported on the frame side wall, the vibration system comprising:

a diaphragm, the diaphragm comprises an annular dome, an annular first suspension, an annular second suspension surrounded by and spaced apart from the first suspension, a first fixation portion bending and extending from a side of the first suspension proximal to the second suspension, the dome located between and connected with the first suspension and the second suspension, the dome comprises an annular dome body and a first dome extending wall bending and extending from the dome body along a direction toward the magnetic circuit system, the first fixation portion connects to and wraps the first dome extending wall;

a voice coil at least partially located in the magnetic gap for driving the diaphragm to vibrate and generate sounds.

2. The acoustic device as described in claim 1, wherein the at least one support wall is formed by extending from a peripheral of the plate body along a vibration direction of vibration system, and the at least one support wall is arranged spaced apart from the frame side wall.

3. The acoustic device as described in claim 1, wherein there is a plurality of said support walls, and each support wall is spaced apart from each other.

4. The acoustic device as described in claim 3, wherein the frame is made of metal material, and each support wall is soldered and fixed to the lower cover.

5. The acoustic device as described in claim 3, wherein the number of the support walls is four, the plate body is in a rectangular shape, the four support walls bend and extend from four sides of the plate body respectively.

6. The acoustic device as described in claim 1, wherein the magnet assembly comprises a main magnet secured on the plate body and a plurality of auxiliary magnets around and spaced apart from the main magnet for forming the magnetic gap.

7. The acoustic device as described in claim 1 wherein the vibration system further comprises a support connecting the diaphragm and the voice coil, the support comprises a support flat wall, a first support extending wall, and a second support extending wall, the support flat wall is attached to a surface of the dome body proximal to the voice coil, the first support extending wall bends and extends from a side of the support flat wall proximal to the first suspension along the direction toward the magnetic circuit system, the first support extending wall is arranged spaced apart from and opposite to the first dome extending wall, the second support extending wall extends from a side of the support flat wall proximal to the second suspension along the direction toward the voice coil and is fixed to the voice coil.

8. The acoustic device as described in claim 1, wherein the first fixation portion comprises a first holding wall bending and extending from a side of the first suspension proximal to the second suspension, a first side wall bending and extending from a side of the first holding wall proximal to the first suspension along a vibration direction toward the magnetic circuit system, a first top wall bending and extending from the first side wall along the direction away from the first suspension, and a second side wall bending and extending from the first top wall along the vibration direction away from the magnetic circuit system, the first side wall, the first top wall, and the second side wall cooperatively enclose a first receiving slot for accommodating the first dome extending wall, an outer peripheral of the dome body is attached to a surface of the first holding wall proximal to the magnetic circuit system.

9. The acoustic device as described in claim 1, wherein the diaphragm further comprises a second fixation portion bending and extending from a side of the second suspension closed to the first suspension, the dome comprises a second dome extending wall bending and extending from a side of the dome body distal to the first dome extending wall to the direction toward the magnetic circuit system, the second fixation portion connects to and wraps the second dome extending wall;

the second fixation portion comprises a second holding wall and a third side wall bending and extending from a side of the second suspension closed to the first suspension, the second holding portion is arranged spaced apart from the third side wall and cooperatively encloses a second receiving slot with the third side wall, the second dome extending wall is received in the second receiving slot, an inner peripheral of the dome body is attached to the side of the second holding wall proximal to the voice coil.

10. The acoustic device as described in claim 1, wherein both of the first suspension and the second suspension are in arc-shaped structures, each of the first suspension and the second suspension has a recess direction, and the two recess directions are in opposite directions.

* * * * *